United States Patent [19]

Hamilton

[11] Patent Number: 5,016,930

[45] Date of Patent: May 21, 1991

[54] BALANCED LATCH BOLT KEEPER SUPPORT SYSTEM

[76] Inventor: William J. Hamilton, 1180 Woodroff Avenue, Ottawa, Ontario, Canada, K2C 2T3

[21] Appl. No.: 410,962

[22] Filed: Sep. 22, 1989

Related U.S. Application Data

[63] Continuation-in-part of Ser. No. 162,598, Mar. 1, 1988, abandoned.

[51] Int. Cl.[5] ..... E05B 15/02

[52] U.S. Cl. ..... 292/340; 292/346

[58] Field of Search ..... 292/340, 341.12, 346, 292/264; 70/92, 451, 417

[56] References Cited

U.S. PATENT DOCUMENTS

| | | | |
|---|---|---|---|
| 2,533,396 | 12/1950 | Payne | 292/340 |
| 2,814,193 | 11/1957 | Roethel | 292/341.12 X |
| 3,888,530 | 1/1975 | Fabrici | 292/340 |
| 3,936,085 | 2/1976 | Long | 292/264 |
| 4,195,870 | 4/1980 | Percoco | 292/340 |
| 4,237,712 | 12/1980 | Cramer | 70/417 |
| 4,369,994 | 1/1983 | Vorves | 292/340 |
| 4,489,968 | 12/1984 | Easley | 292/340 |
| 4,547,009 | 10/1985 | Allen | 292/340 X |
| 4,550,939 | 6/1987 | Babb, Jr. et al. | 292/340 |
| 4,809,400 | 3/1989 | Allen | 292/340 X |
| 4,832,386 | 5/1989 | Sweet | 292/340 X |

FOREIGN PATENT DOCUMENTS

| | | | |
|---|---|---|---|
| 56295 | 9/1952 | France | 292/340 |

*Primary Examiner*—Jose V. Chen

*Attorney, Agent, or Firm*—Burke-Robertson

[57] ABSTRACT

A security device for a door frame for a fastening in a cavity a door frame cavity behind a strike plate. The device comprises a short length of flat bar to be fastened directly to an internal portion of a door frame at the height of a latch bolt receptacle so that a relatively large area of a surface of the bar provides a solid buttress support contact for the latch bolt when in the latch bolt receptacle, the bar thereby serving as a high strength, adjustable latch bolt keeper. Fasteners and holes in the bar provides for connections to the door frame, the cover-plate-and-strike, and to a safety chain as may be required.

11 Claims, 2 Drawing Sheets

BALANCED LATCH BOLT KEEPER SUPPORT SYSTEM

This is a continuation-in-part in respect of my U.S. Pat. Application Ser. No. 162,598 filed Mar. 1, 1988 now abandoned.

BACKGROUND OF THE INVENTION

The present invention relates to a device for simultaneously reinforcing a door frame and serving as an engagement surface for the bolt (e.g. latch bolt or dead bolt) of a door.

Conventional strike plates and dead bolt keepers provide a narrow latching or engagement surface which will often bend or tear when a closed door is subjected to an attack force. When the strike plate bends or tears, very little additional force on the door may be required to cause the latch bolt or dead bolt to come loose from the receptacle in the door frame located behind the strike, thereby enabling the door to be opened.

Patents of general background interest describing reinforcing means for keepers or strike plates include U.S. Pat. Nos. 2,533,396 issued Dec. 12, 1950 of Payne, 4,186,954 issued Feb. 5, 1980 of Detlefs and 4,211,422 issued Jul. 8, 1980 of Hansen. The keepers and lock strike plate assemblies of these devices require special, relatively complicated constructions. U.S. Pat. No. 4,369,994 of Vorves issued Jan. 25, 1983 describes and illustrates a strike plate support comprising a U-shaped, two-piece connection which bolts into a door frame, to circumscribe the upper, lower and outer peripheries of the receptacle for the door latch or bolt. A strike plate fits over this device and is secured to the door frame by normal wood screws. The device illustrated in this patent, in operation produces significant bending stresses on the door latch or bolt. Also, the hinge pin which joins elements forming the "U" is a point at which the unit may structurally fail is subjected to high impact forces.

Another reference of background interest is U.S. Pat. No. 3,888,530 issued Jun. 10, 1975 of Fabrici which describes and illustrates a bolt guard for a door in the form of, for example, a U-shaped plate which wraps around and sits on a door frame, and is anchored thereto. In another reference of interest, French Patent of Addition No. 56295 of Ghione granted Jul. 16, 1952, a leaf spring is mounted on the exterior of a box type lock catch, to reinforce that catch.

Other patents of general background interest are Canadian Patent No. 1,119,640 issued Mar. 9, 1982, U.S. Pat. Nos. 3,767,245 issued Oct. 23, 1973, 4,195,780 issued Apr. 1, 1980, 4,237,712 issued Dec. 9, 1980 of Cramer, 3,809,418 issued May, 1974 of Canfield, 3,936,085 issued Feb. 3, 1976 of Long, and 4,195,870 issued Apr. 1, 1980 of Percoco, U.S. Design Pat. No. Des. 263,675 issued Apr. 6, 1982 of Vorves, U.S. Pat. Nos. 4,489,968 issued Dec. 25, 1984 of Easley, 2,814,193 issued Nov. 26, 1957 of Roethel, 4,673,204 issued Jun. 16, 1987 of Allenbaugh and 4,474,394 issued Oct. 2, 1984. Many of the strike plate support assemblies of these patents have reinforcement means extending in a direction perpendicular to the door frame surface and hence perpendicular to the direction in which an attacking force to the door might be applied.

SUMMARY OF THE INVENTION

In accordance with the present invention there is provided a device for simultaneously reinforcing a door frame and providing a very high strength engagement surface for a latch bolt of a door. The device comprises an elongated bar in the form of a rectangular parallelepiped. It has a large, flat longitudinally-extending engagement surface for a latch bolt extending parallel to the longitudinal axis of the bar. It is mounted in the door frame with the engagement surface of the bar positioned with respect to a latch bolt receptacle in that door frame and with respect to the latch bolt when the door is closed, to hold the latch or dead bolt securely in place in the receptacle. Long common fasteners extend centrally through the bar at spaced locations in a direction perpendicular to the engagement surface and into the door frame, preferably at locations equally spaced from the position of the latch bolt when seated in the latch bolt receptacle, to hold the bar firmly in place in the frame. The common fasteners are positioned, when the bar is appropriately mounted, so that balanced resistance is given by the bar and fasteners to an attacking force on the door transmitted to the device by the latch bolt.

In a preferred embodiment of the present invention, the device further comprises a thin sheet cover-plate-and-strike, to be secured to the bar by securing means thereby to form an integral assembly serving as a strike plate, a coverplate for the device cavity, a positioning means for locating the bar at or close to the ideal lateral position flush with the surface of the door frame and a strong well-anchored engagement surface to properly secure a latch or deadbolt. In this embodiment the sheet does not itself engage the latch bolt to maintain door closure.

The device according to the present invention provides a high strength universal type of replacement device for strike plates and dead bolt keepers. The device, in a preferred construction, forms an integral assembly with the cover-plate-and-strike, that is adjustably attached to a door frame by means of the long common fasteners. The device in addition to serving as a very effective door frame reinforcement, gives a balanced high resistance with respect to the fasteners, in direct opposition to any attack force against the door, when located close to the mounting surface of the frame. It is easily installed and economically manufactured.

OBJECTS OF THE INVENTION

Accordingly, it is an object of the present invention to provide a low cost high strength universal type of securing mechanism applicable to most common door frames in new or existing housing, requiring only the simplest of modifications to the frame itself for installation.

Another object is to provide a strong latch bolt engagement means that is countersunk into the normal strike-mounting corner of a door frame so as to be flush with the normal strike-mounting surface of the frame.

Another object is to provide an anchoring means which will serve three important functions; to concentrate its holding power along the vertical centerline of the latch bolt engagement surface area without any mechanically offset support; to distribute its holding power over a large internal section of the door frame; and to provide a simple adjustment of the latch bolt engagement member's contact surface position for optimum door closure.

Another object is to provide a replacement apparatus that will allow the removal and discarding of an existing strike plate, and be surface mounted to completely cover the cavity of the old strike plate.

Another object is to provide a mechanical design which does not depend on the resistance-to-shearing stresses in fasteners or other small sections, for support against impact forces.

Another object is to provide a cover plate that serves in a way that is similar to a conventional strike, but does not itself provide the latch engagement function to maintain door closure. A further object of the cover plate is to conceal the internal security mechanism and its frame cavity.

A further object of the invention is to provide a device which requires only a moderate degree of skill for installation, and which may be quickly installed.

Another object is to provide an apparatus which is capable of a simple re-adjustment at any time for optimum door closure.

A still further object for one embodiment of the invention is to provide a strong body structure for the high strength anchoring of a door chain during installation, or at a later time as required by the user.

Yet another object of this invention is to provide a simple mechanical assembly for easy manufacture, which may be included in a package as part of a common lock installation kit.

BRIEF DESCRIPTION OF THE DRAWINGS

These and other objects and advantages of the invention will become apparent upon reading the following detailed description and up on referring to the drawings in which.

Figure 1:
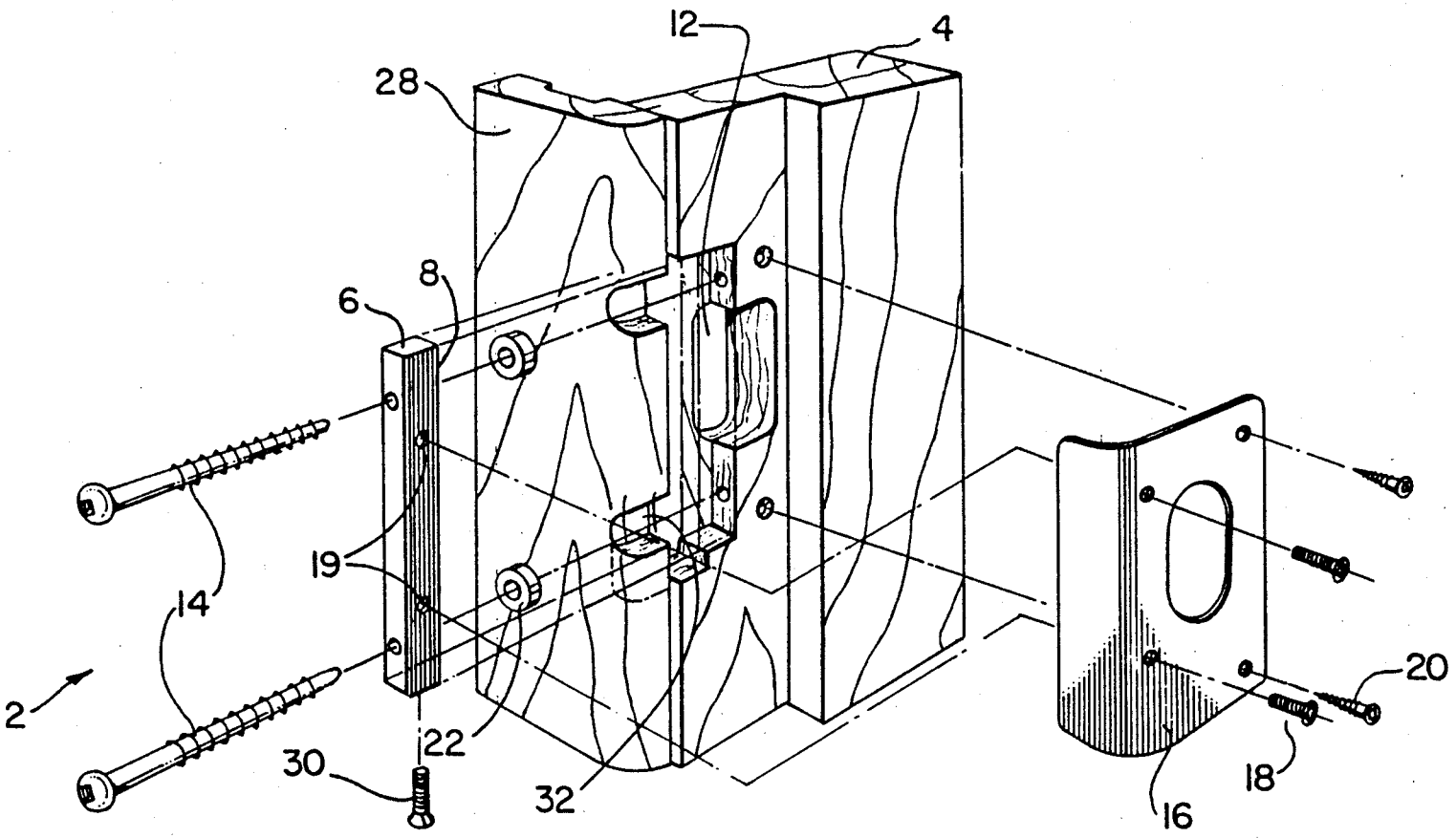
FIG. 1 is an exploded perspective view of a device in accordance with the present invention mounted in a door frame.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE INVENTION

In the following description, similar features in the drawings have been given similar reference numerals.

Figure 2:
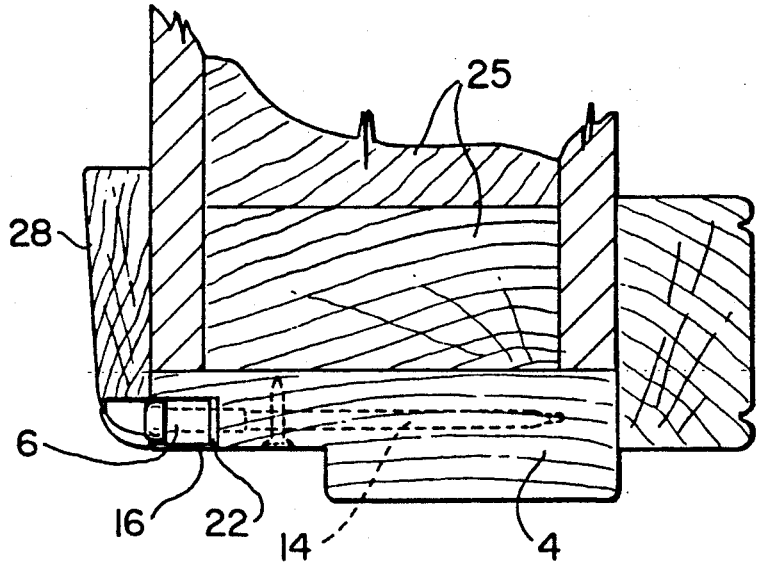
FIG. 2 is a section view of the device taken through the door frame, immediately above the device, along line II—II of FIG. 3.
Figure 3:
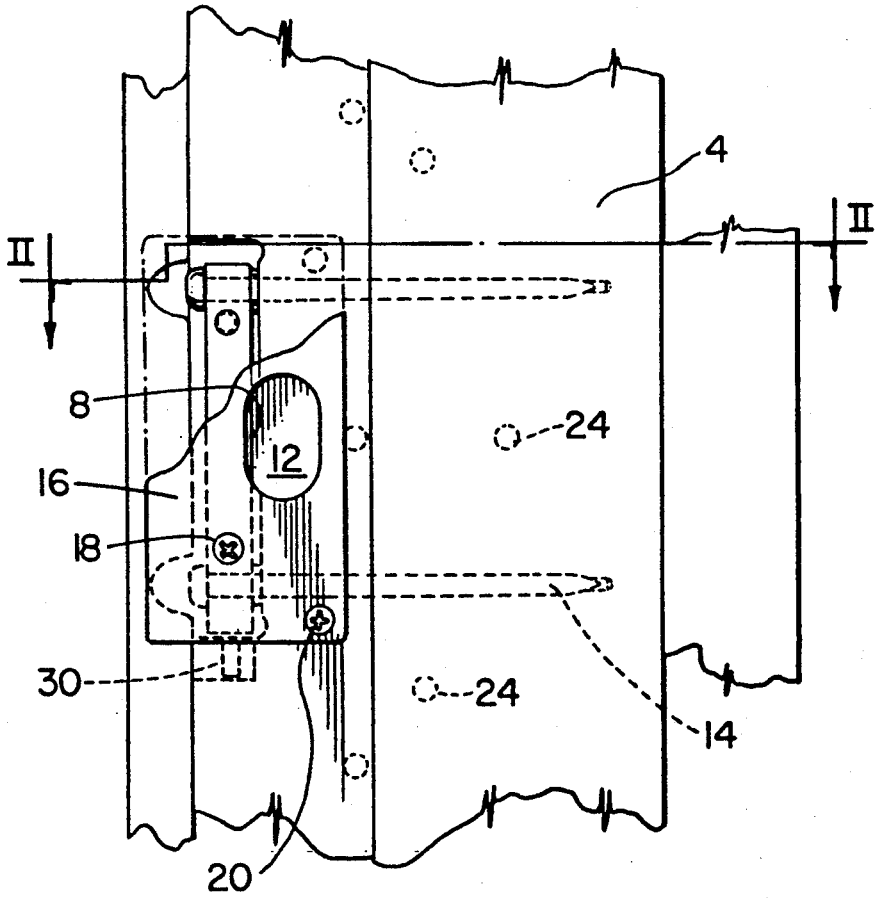
FIG. 3 is an elevation view, partially broken away, of the device of FIG. 1.

Turning to FIG. 1 there is illustrated a device 2 for simultaneously reinforcing a door frame and serving as an engagement surface for the latch bolt thereof, mounted in a door frame 4. Device 2 comprises an elongated flat bar 6 in the form of a rectangular parallelepiped of substantially uniform cross-section in the lateral direction. That cross-section is preferably rectangular or square. It is preferred that the dimensions of such cross-section are of the same order of magnitude but neither is more than twice the other. A wide (e.g. ⅜") flat longitudinally-extending engagement surface 8 extends along one side of bar 6, engagement surface 8 to be mounted in the door frame, as illustrated in FIGS. 2 and 3, so that it is properly positioned, with respect to the latch bolt receptacle 12 in the door frame 4, so that when the door is closed, it holds the latch bolt or latch properly within the receptacle.

Bar 6 is held in position by means of long common fasteners 14 which, in the illustrated embodiment, are elongated wood screws. These fasteners 14 extend centrally through bar 6 in a direction perpendicular to engagement surface 8 into frame 4 to hold bar 6 firmly in place in the frame and resist in a balanced fashion, with respect to fasteners 14, any forces which might be applied to the door to open it while closed or locked. Bar 6, when thus held in position, is balanced in the sense that it distributes its load-carrying resistance to impact forces symmetrically in the vertical and horizontal planes. This is achieved, in the vertical plane, by the fasteners 14 having their center lines coincident with the vertical center line of the bar 6, and horizontally by fasteners 14 being positioned, in bar 6 at locations equally spaced from the position of the latch bolt when positioned in the bolt receptacle 12. In this way a balanced resistance is given by bar 6 and fasteners 14 to an attacking force on the door (transmitted to it by the latch bolt).

A cover-plate-and-strike 16, comprising for example a thin piece of sheet metal, is surface mounted on frame 4 as illustrated, using machine screws 18 extending through holes in cover plate 16 into threaded holes 19 in bar 6. The heel corners of cover plate 16 are simply fastened to frame 4 by means of ordinary wood screws 20 as illustrated. The sheet does not itself engage the latch bolt to maintain door closure.

Flexible washers 22, mounted on fasteners 14 and positioned between bar 6 and adjacent portion of frame 4, are used to provide a resilient means for achieving a continuously adjustable assembly for optimum door closure. After adjusting the lateral positioning of engagement surface 8 with respect to receptacle 12, by means of appropriately rotating fasteners 14, bar 6 is then held firmly in place. If necessary, plastic wood (not illustrated) may be forced into the spaces between confronting surfaces of frame 4 and engagement surface 8 in the vicinity of the compressed rubber washers 22.

For further security, a plurality of wall pins 24 (FIG. 3) may be driven into pilot holes through frame 4 into studs 25 to provide extra support and strength from the wall structure.

Installation of the device is readily achieved by simply routing out a small portion of the front edge of door frame 4 and frame-to-wall cover strip 28 as illustrated in FIG. 1, for example with the aid of an appropriate guide template, and drilling of horizontal pilot holes deep in the door frame for long common fasteners 14. Holes in bar 6 may be used as a hole template for drilling these pilot holes, while the assembly is hand held in place. Using the small rubber washers 22 as previously described, the bar 6 may be appropriately laterally positioned with respect to receptacle 12 for optimum door closure, and plastic wood applied as previously described, if desired. Cover-plate-and-strike 16 is then connected in fixed relation to bar 6 with machine screws 18 and finally the heel corners of cover plate 16 are fastened to the door frame, by means of wood screws 20.

If desired, bar 6 may be provided with a chain-receiving fastener 30 or other such securing means, to which a conventional interior door lock safety chain (not illustrated) may be anchored.

Impact testing in general accordance with ASTM F-476-76, of the device in accordance with the present invention, has shown that, in addition to serving as a very effective door frame reinforcement, the long common fasteners 14 in conjunction with bar 6 and its engagement surface 8 give a balanced high resistance on the bar in direct opposition to any attack force against the door, when the device is located close to the mounting surface of the door frame.

To summarize, the latch bolt keeper device of the present invention itself is a single, short length of solid body material which is essentially square or rectangular in lateral cross-section, mounted (counter-sunk) into the door frame only. The device provides a wide latch bolt keeper engagement surface, a high strength reinforcement body for that surface and a form of body section that is easily anchored on its longitudinal center line to thereby directly anchor the full contact surface of the bar in its central area for support of a latch bolt. The bar may be easily adjustable at any time for optimum door closure. It is easily concealed within the door frame, and forms an internal part of the door frame itself so as not to appreciably exceed the frame's original surface dimensions. The long common fasteners 14, when used in combination with, for example a square-sectioned reinforcing bar 6, provide direct anchoring deep into the door frame, an adjustable means for finally positioning the flat bar, a means for anchoring the flat bar which also reinforces the internal sections of the wooden door frame in order to prevent splitting and concealment of the anchoring fasteners within the door frame structure itself.

The combination of the cover-plate-and-strike with the elongated bar of the present invention to form an integral assembly provides a concealment means for the cavity which contains bar 6 and its fasteners 14, and a conventional strike lip to actuate the latch bolt for door closure. In combination with the adjustable nature of the bar, the location of the cover-plate-and-strike may be adjusted in a similar manner. This integral assembly serves as both an engagement surface for the latch bolt of the door, when the door is closed, as well as a strike plate for the latch bolt when the door is closing.

Thus, it is apparent that there has been provided in accordance with the invention an improved balanced latch bolt keeper support system that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A security device for a door frame for fastening in a door frame cavity adjacent to a latch bolt receptacle, the device comprising the combination of:

(a) a vertically oriented short length of flat bar fastened in the cavity at the height of the latch bolt receptacle so that a relatively large area of a surface of the bar forms a contact surface for the latch bolt when in the latch bolt receptacle, the bar thereby serving as a latch bolt keeper;

(b) a plurality of apertures extending through the bar in a direction perpendicular to the contact surface at spaced locations which are above and below the latch bolt receptacle when the bar is in position;

(c) long common fasteners extending centrally through the bar in said apertures to hold the bar firmly in position in the frame; and (d) a thin sheet cover-plate-and-strike releasably secured to the bar so as to be surface mounted on the frame by screws securable through the cover-plate-and-strike to the bar in a direction 90° to that of the long common fasteners, thereby forming an integral assembly and serving as both a strike plate and reinforced engagement surface for the latch bolt, the sheet itself not engaging the latch bolt to maintain door closure.

2. A combination of a door frame having a latch bolt receptacle and a security device according to claim 1 secured in a cavity within said door frame behind the strike plate, the flat bar fastened directly to an internal portion of the door frame at the height of the latch bolt receptacle so that a relatively large area of the surface of the bar forms the contact surface for the latch in the latch bolt receptacle, the bar to thereby serve as a latch bolt keeper.

3. A device according to claim 1 wherein a pair of common fasteners extend through the bar at spaced locations centered with respect to the longitudinal center line of the bar and equally spaced from the position of the latch bolt when positioned in the latch bolt receptacle to give a balanced resistance to an attacking force on the door.

4. A device according to claim 3 wherein the common fasteners are elongated wood screws.

5. A device according to claim 1 wherein the cover-plate-and-strike is surface mounted when secured to the bar and in position on a door frame.

6. A device according to claim 1 wherein the cover-plate-and-strike securing means comprise machine screws passing through holes in the plate and strike to threadably engage in holes aligned in the bar.

7. A device according to claim 1 wherein flexible washers are positioned on the common fasteners between the bar and the door frame when the device is mounted in a door frame.

8. A device according to claim 1 further comprising securing means attached to the bar for securely anchoring in position one end of an interior door lock safety chain.

9. A device according to claim 1 wherein each of the long common fasteners has a central axis and is located so that a plane passing through the central axes of said long common fasteners also passes through the latch bolt receptacle.

10. A device according to claim 1 wherein the bar has a substantially uniform rectangular lateral cross-section.

11. A device according to claim 1 wherein the bar has a substantially uniform square lateral cross-section.

* * * * *